US006491590B2

(12) United States Patent
Vigorita et al.

(10) Patent No.: US 6,491,590 B2
(45) Date of Patent: Dec. 10, 2002

(54) NOVELTY STORAGE STAND WITH INTEGRAL PUTTING TARGET

(76) Inventors: Joseph Vigorita, 635 Bell La., Maple Glen, PA (US) 19002; David Newns, 718 Easton Rd., Glenside, PA (US) 19038

( * ) Notice: Subject to any disclaimer, the term of this patent is extended or adjusted under 35 U.S.C. 154(b) by 12 days.

(21) Appl. No.: 09/760,910

(22) Filed: Jan. 16, 2001

(65) Prior Publication Data

US 2001/0032912 A1 Oct. 25, 2001

Related U.S. Application Data

(60) Provisional application No. 60/175,830, filed on Jan. 13, 2000.

(51) Int. Cl.[7] ..... A63B 69/36; A46B 4/00

(52) U.S. Cl. ..... 473/180; 15/21.2

(58) Field of Search ..... 473/172, 174, 473/180, 181, 185–189, 162, 196; 15/104.92, 21.1, 27.2

(56) References Cited

U.S. PATENT DOCUMENTS

| | | | | | |
|---|---|---|---|---|---|
| 2,459,559 | A | * | 1/1949 | Watkins | 473/180 |
| 3,114,556 | A | * | 12/1963 | Miller | 273/123 R |
| 3,748,676 | A | * | 7/1973 | Warren et al. | 15/104.92 |
| 5,456,203 | A | * | 10/1995 | Oglesby et al. | 116/209 |
| 5,645,492 | A | * | 7/1997 | Anderson | 473/185 |
| 5,647,082 | A | * | 7/1997 | Garske et al. | 15/104.92 |
| 5,664,277 | A | * | 9/1997 | Matlock | 15/104.92 |
| 5,967,408 | A | * | 10/1999 | Garabedian | 131/329 |

* cited by examiner

*Primary Examiner*—Mark S. Graham
(74) *Attorney, Agent, or Firm*—Akin, Gump, Strauss, Hauer & Feld, L.L.P.

(57) ABSTRACT

The present invention relates to a storage device including a container having a first opening. An optional cover is in releasable engagement with a container to cover the first opening. The storage device additionally includes a base having a target for receiving an object and a member having a first end attached to the container and a second end attached to the base.

3 Claims, 1 Drawing Sheet

NOVELTY STORAGE STAND WITH INTEGRAL PUTTING TARGET

CROSS-REFERENCE TO RELATED APPLICATIONS

This application is related to Provisional Application No. 60/175,830, filed Jan. 13, 2000 and claims the earlier filing date of the provisional application under 35 U.S.C. §119(e).

BACKGROUND OF THE INVENTION

This invention relates generally to a novelty stand to be used in the office or in the home. More particularly, this invention relates to a novelty storage stand having a portion thereof formed in the shape of a structure that is associated with the article stored therein or an activity involving the stored article.

Individuals in homes and offices and in public places, such as hotel lobbies and shops enjoy seeing decorative articles that are conversational pieces and that simultaneously have an alternative use. For example, golfers enjoy being reminded of and talking about the pleasant times spent on the golf course even though they may be at home or in the office and unable to play a round of golf.

A decorative stand in the shape of a golf ball washer appropriately placed in a home or office may stimulate a conversation with visitors about a particularly enjoyable round of golf. A decorative novelty stand that is shaped in the form of a golf ball washer and that contains golf balls that may be removed and putted towards a target in the base of the stand simulating a hole on the putting green additionally provides an opportunity to enhance the conversation by permitting the conversers to practicing putting.

Further, should the golf ball washer have a cover with a humidifier attached thereto, the container alternatively could be used as a humidor for the storage of cigars, thereby permitting the conversers to enjoy a cigar while putting.

In yet another use, the container, without a cover, could be used to house a floral arrangement or a scented article evoking sensory perceptions of a favorite outdoor location such as a particular golf course green surrounded by memorable flora.

A novelty storage stand with an integral putting target that can be used in the office or in the home for storing for golf balls, cigars, candy and the like, that evokes memories of a favorite putting green and that additionally provides an opportunity for practicing putting would be a valuable addition to any home or office.

BRIEF SUMMARY OF THE INVENTON

Briefly stated, one aspect of the present invention is a storage device including a container having a first opening and an optional cover in releasable engagement with the container to cover the first opening. The storage device additionally includes a base having a target for receiving an object. A member having a first end is attached to the container and a second end is attached to the base.

Another aspect of the present invention is a storage device having a hollow generally circular-shaped cylinder having an open end and a tapered closed end. A generally circular-shaped cover is in releasable engagement with the open end of the circular-shaped cylinder to cover the open end. The cover has a first surface and a second surface. The first surface of the cover has a depression for holding an article. A spherically-shaped handle is mounted at the center of the first surface of the cover. The storage device additionally includes a generally circular disk-shaped base having an outer edge with a semi-circular-shaped notch for receiving a putted golf ball. An elongated rod having a first end is attached to the tapered closed end of the circular cylinder and a second end is attached to the disk-shaped base.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
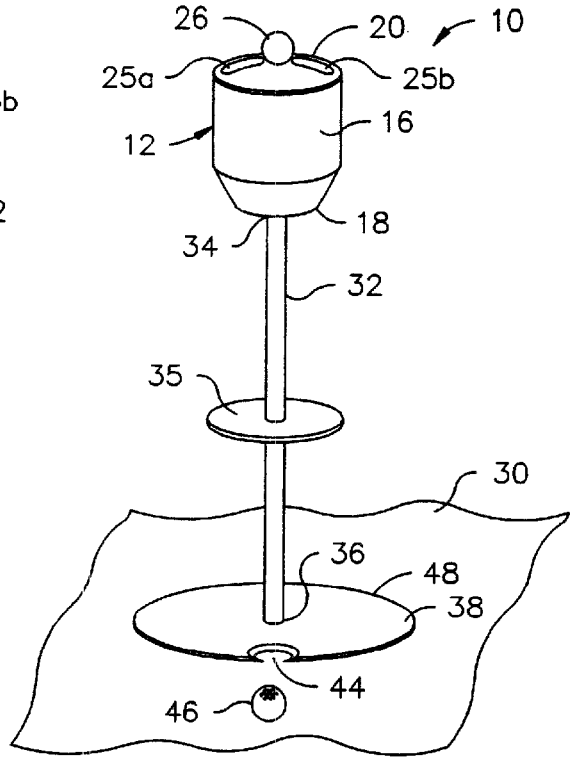
FIG. 1 is a front perspective view of the storage device in accordance with the present invention.
Figure 2:
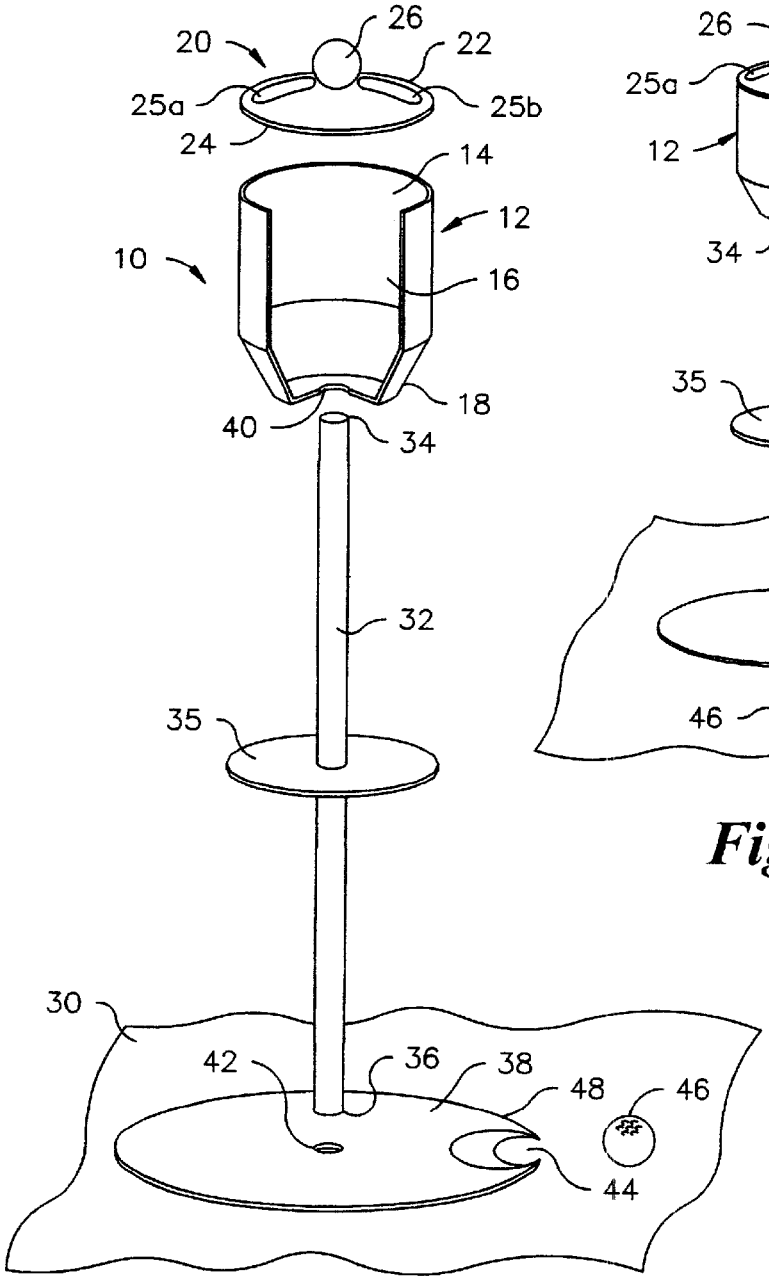
FIG. 2 is an enlarged exploded side perspective view, partially broken away, of the storage device in FIG. 1.

Referring to the drawings in detail, where like numerals indicate like elements throughout there is shown in FIGS. 1–2 a first preferred embodiment of the storage device, generally designated 10, and hereinafter referred to as the "storage device" 10, in accordance with the present invention. The storage device 10 has a container 12 having a first opening 14. In the first preferred embodiment, the container 12 is a hollow circular cylinder 16 having an open end corresponding to the first opening 14 and a tapered closed end 18. Those of ordinary skilled in the storage device art will understand from the present disclosure that the container 12 is not limited to a cylindrical shape and that the container 12 could have an arbitrary shape provided that the container has a hollow center and an opening for receiving articles to be stored such as golf balls, cigars, cigarettes, candy or any other specialty item (not shown).

The storage device 10 has a cover 20 in releasable engagement with the container 12 to cover the first opening 14. In the first preferred embodiment, the cover 20 is generally circular in shape and complements the open end of the hollow cylinder 16. The cover 20 has a first downwardly and radially outwardly slopping surface 22 and a second generally planar surface 24. The first surface 20 has opposed radially extending depressions 25*a*, 25*b* therein for holding an article (not shown). In the first preferred embodiment, the article to be held is a golf ball and the depressions 25*a*, 25*b* have a cross sectional shape generally corresponding to a portion of the circumferencial surface of a golf ball. Those having ordinary skill in the container art will understand that the cover 20 could have a planar, depressionless first surface or have a first surface with an arbitrary contour and with one or more non-radially oriented depressions that have a shape corresponding to other articles such as a cigar, a glass, or any other article of interest.

A spherically shaped handle 26 is mounted at the center of the first surface 22. In the first preferred embodiment, the spherically-shaped handle 26 is generally in the form of a sphere, which is sized to be similar to a golf ball. Those of ordinary skill in the storage device art will understand from the present disclosure that the handle 26 is not limited to a spherical shape and that the handle 26 could generally be in the form of articles, other than golf balls, that could be stored in the storage device 10, such as cigars, cigarettes, candy or any other specialty item provided that the handle 26 provides a grip for removing the cover 20 from the first opening 14. Those having ordinary skill in the container art also will understand from the present disclosure that a cover 20 is not required for the container 12 and still frtther that a cover 20, if provided, need not be circular in shape. The cover could have an arbitrary shape provided that a portion of the cover corresponds in shape to the shape of the first opening 14 in the container 12.

The container 12 is supported above a supporting surface 30 (partially shown) a predetermined distance, preferably at a height which is similar to the height of golf ball washers found on golf courses. The container 12 is supported by the combination of a member 32, preferably in the shape of an elongated rod, having a first end 34 attached to the container 12 and a second end 36 attached to a base 38. In the first preferred embodiment, the member 32 is generally circular in cross-section and the tapered closed end 18 of the container 12 has a hole 40 at its external bottom large enough to complementarily receive the first end 34 of the member 32. The member 32 additionally has a platform 35, preferably in the general shape of a disc, spaced apart from the first end 34 for holding an article (not shown) such as a glass, an ash tray, or any other article of interest. Those having ordinary skill in the storage device art will understand from the present disclosure that the platform 35 could have an arbitrary shape provided that the platform 35 supports an article of interest. In the first preferred embodiment, the first end 34 is secured with adhesive to the container 12. Those having ordinary skill in the storage device art will understand from the present disclosure that other fastening systems, such as a press fit, could be used to secure the member 32 to the container 12 without departing from the spirit and scope of the invention.

The base 38 is a generally circular-shaped disk roughly one-half inch thick which provides support for the container 12 and the member 32. The second end 36 of the member 32 is adhesively secured within a complementarily-shaped hole 42 in the base 38. Alternatively, the second end 36 of the member 32 could be press fit within the hole 42 in the base 38. Those having ordinary skill in the storage device art will understand from the present disclosure that the base 38 can have an arbitrary shape and thickness provided that it is capable of supporting the container 12 and the member 32.

The base 38 has a target 44 for receiving an object 46. Preferably, the object 46 is a golf ball and the target 44 is formed in an outer edge 48 of the base 38 and is shaped in the form of a semi-circular notch for receiving a putted golf ball. Those having ordinary skill in the storage device art will understand from the present disclosure that the object 46 is not limited to a golf ball and that the target 44 is not limited to a semi-circular shaped notch. The object 46 could be any article that is rolled, thrown, propelled or otherwise directed towards the target 44 and can include articles such as balls, bean bags, coins, and other articles suitable for storage in the container 12. Additionally, the target 44 could have any shape that is complementary to the aforementioned alternative objects.

The storage device 10 is preferably fabricated of a high strength lightweight material, such as wood or polymeric material.

In operation, a plurality of objects 46 are stored in the container 12. The user lifts the cover 20 using the spherically-shaped handle 26 to access and remove an object 46 from the container 12. The object 46 is then moved a distance from the storage device 10 and then directed towards the target 44 in the base 38. In a preferred usage, the object 46 is a golf ball. A plurality of golf balls are stored in the container 12. Access to the golf balls is provided by removal of the cover 20. One or more golf balls is placed on the supporting surface 30 and putted towards the semi-circular-shaped notch in the base 38, thereby practicing putting. When putting practice is completed, the golf balls are returned to the container 12 and the cover 20 is placed on the container 12.

Figure 3:
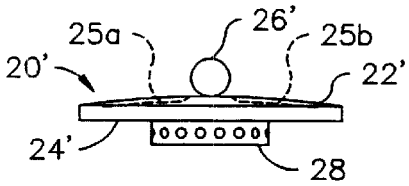
FIG. 3 is a side elevational view of a cover having a humidifier.

Referring now to FIG. 3, there is shown a second preferred embodiment of the storage device 10. In the second preferred embodiment, the cover 20' has a humidifier 28 attached to the second surface 24' of the cover 20'. The remaining components are the same as the components disclosed above for the first preferred embodiment and therefore, in the interest of brevity are not again disclosed. Those of ordinary skill in the storage device art will understand from the present disclosure that the container 12 together with the cover 20' having a humidifier 28 forms a humidor that can be used to house cigars or other articles requiring a humid environment.

Those skilled in the art will appreciate that changes could be made to the embodiments described above without departing from the broad inventive concept thereof. For instance, the container 12 in conjunction with the lid 20 could be used to house beanbags, in which case, the target 44 could be shaped to receive beanbags. In yet another use, the container 12, without a cover 20, could be used to house a floral arrangement or a scented article evoking sensory perceptions of a favorite outdoor location such a particular golf course green surrounded by memorable flora. Therefore, those having ordinary skill in the storage device art will understand from the present disclosure that the invention is not limited to the particular embodiments disclosed, but it is intended to cover modifications within the spirit and scope of the present invention as defined by the appended claims.

We claim:

1. A storage device comprising:

a hollow generally circular-shaped cylinder having an open end and a tapered closed end;

a generally circular-shaped cover in releasable engagement with the open end of the circular-shaped cylinder to cover the open end, the cover having a first surface and a second surface, the first surface having a depression for holding an article;

a spherically-shaped handle mounted at the center of the first surface of the cover;

a generally circular disc-shaped base having an outer edge with a semicircular-shaped notch for receiving a putted golf ball; and an elongated rod having a first end attached to the tapered closed end of the circular cylinder and a second end attached to the disc-shaped base.

2. The storage device according to claim 1, wherein a humidifier is attached to the second surface of the cover.

3. The storage device according to claim 1, wherein the elongated rod has a platform spaced apart from the first end for holding an article.

* * * * *